US010961998B2

(12) United States Patent
Bethke

(10) Patent No.: US 10,961,998 B2
(45) Date of Patent: Mar. 30, 2021

(54) ELECTRO-HYDRAULIC SWASHPLATE CONTROL ARRANGEMENT FOR AN AXIAL PISTON PUMP

(71) Applicant: Hartmann Controls, Inc., Hartland, WI (US)

(72) Inventor: Donald G. Bethke, Bonita Springs, FL (US)

(73) Assignee: Hartmann Controls, Inc., Hartland, WI (US)

( * ) Notice: Subject to any disclaimer, the term of this patent is extended or adjusted under 35 U.S.C. 154(b) by 237 days.

(21) Appl. No.: 15/915,460

(22) Filed: Mar. 8, 2018

(65) Prior Publication Data

US 2019/0277275 A1 Sep. 12, 2019

(51) Int. Cl.

| | |
|---|---|
| ***F04B 49/00*** | (2006.01) |
| ***F04B 49/12*** | (2006.01) |
| ***F04B 9/04*** | (2006.01) |
| ***F04B 1/324*** | (2020.01) |

(52) U.S. Cl.

CPC ..... *F04B 49/002* (2013.01); *F04B 1/324* (2013.01); *F04B 9/045* (2013.01); *F04B 49/125* (2013.01); *F04B 2201/12051* (2013.01)

(58) Field of Classification Search

CPC .. F04B 49/002; F04B 1/30; F04B 1/32; F04B 1/324; F04B 1/28; F04B 1/295; F04B 49/12; F04B 49/123; F04B 2201/1205; F04B 2201/12051

USPC ..... 417/269, 270

See application file for complete search history.

(56) References Cited

U.S. PATENT DOCUMENTS

| | | | | |
|---|---|---|---|---|
| 5,794,515 | A | 8/1998 | Bethke | |
| 5,839,885 | A * | 11/1998 | Oda | F04B 49/002 417/213 |
| 6,725,658 | B1 | 4/2004 | Lemmen et al. | |
| 9,482,212 | B1 | 11/2016 | Bethke | |

(Continued)

FOREIGN PATENT DOCUMENTS

| | | | |
|---|---|---|---|
| JP | 2017115749 | A | 6/2017 |
| WO | 2017027517 | A1 | 2/2017 |
| WO | 2017083839 | A1 | 5/2017 |

OTHER PUBLICATIONS

International Search Report and Written Opinion for International Application No. PCT/US2019/020256, dated May 15, 2019.

*Primary Examiner* — Philip E Stimpert

(74) *Attorney, Agent, or Firm* — Andrus Intellectual Property Law, LLP

(57) ABSTRACT

A control arrangement controls a position of a swashplate in an axial piston pump between a no-stroke position and a maximum stroke position. The control arrangement includes a servo spool mounted for limited sliding movement in a compensator piston cylinder. A solenoid coil is configured to provide a coil force to move the servo spool. A compensator piston is mounted in the compensator piston cylinder in response to movement of the servo spool. A spring between the servo spool and the compensator piston provides a spring force in response to the coil force applied to the servo spool. The control arrangement defines a feedback system configured to maintain a balancing relationship between the spring and coil forces to enable infinite control of the swashplate position.

14 Claims, 6 Drawing Sheets

(56) References Cited

U.S. PATENT DOCUMENTS

| | | | | |
|---|---|---|---|---|
| 2009/0007773 | A1* | 1/2009 | Zhu | F04B 1/128<br>91/505 |
| 2009/0288552 | A1* | 11/2009 | Beck | F04B 1/324<br>91/505 |
| 2014/0130661 | A1 | 5/2014 | Howind et al. | |

* cited by examiner

ELECTRO-HYDRAULIC SWASHPLATE CONTROL ARRANGEMENT FOR AN AXIAL PISTON PUMP

FIELD OF THE INVENTION

The present disclosure relates generally to an axial piston pump, and more particularly, pertains to a variable displacement pump having an improved swashplate control arrangement which provides infinite control of swashplate position regardless of pump output pressure.

BACKGROUND

Axial piston pumps are old and well known in the art. All such pumps include a swashplate against which axial piston ends of piston assemblies bear, and along which such ends rotate with an angled reaction surface of the swashplate allowing a cyclic reciprocal movement of the pistons in the piston assemblies providing each piston-holding cylinder with low pressure intake and high pressure discharge of hydraulic fluid on each rotation. The swashplate is mounted for rotation on a tilt axis transverse to a longitudinal axis of a drive shaft which drives a cylindrical rotor housing the pistons. Axial piston pumps typically rely on a control arrangement for tilting the swashplate between a no flow, null or no-stroke position and a maximum flow or maximum stroke position. Such control arrangement commonly includes a volume control piston assembly having a volume control piston, and a pressure compensator piston assembly having a compensator piston with a diameter which is larger than the diameter of the volume control piston. The volume control piston functions to bias the swashplate towards the no-stroke position, while the compensator piston biases the swashplate towards the maximum stroke position. Traditional swashplate position controls use feedback systems and various separate devices such as a proportional solenoid (servo) valve, rotary position sensors, LVDTs (linear variable differential transducers), pressure transducers, etc. to monitor the position of the swashplate, and, then through electronic controls (micro processors) and programs that control the servo valve, to hold various positions to accomplish functions such as horsepower limiting, load sensing and pressure compensation. Such separate servo valves can be very expensive.

It is desirable to provide a swashplate control arrangement for controlling the position of a swashplate which eliminates the separate servo valve and provides direct feedback from a stroking servo spool in the compensator piston assembly to result in true position sensing.

SUMMARY

The present disclosure relates to a swashplate control arrangement for controlling a position of a swashplate mounted for tilting movement in an axial piston pump between a no-stroke position and a maximum stroke position. The swashplate control arrangement includes a compensator piston assembly configured to bias the swashplate between the no-stroke position and the maximum stroke position. The compensator piston assembly includes a compensator piston cylinder, and a servo spool mounted for sliding movement within the compensator piston cylinder. A solenoid coil is disposed in surrounding relationship with the servo spool, and is configured to provide a coil force to control movement of the servo spool. A compensator piston is spaced from the servo spool and mounted for sliding movement within the compensator piston cylinder in response to movement of the servo spool. A spring is connected between the servo spool and the compensator piston, and is configured to provide a spring force in response to the coil force applied to the servo spool to control movement thereof. The swashplate control arrangement defines a feedback system configured to maintain a balancing relationship between the spring force and the coil force to enable infinite control of the swashplate position.

The present disclosure also relates to a control arrangement for controlling the position of a swashplate on a tilt axis. The control arrangement includes a compensator piston assembly which is configured to bias the swashplate between a no-stroke position and a maximum stroke position. The compensator piston assembly includes a compensator piston cylinder having a closed end and an open end. A servo spool is mounted for limited sliding movement within the closed end of the compensator piston cylinder. A solenoid coil is disposed within the closed end of the compensator piston cylinder in surrounding relation with the servo spool, and is configured to be connected to a source of electrical power to provide a coil force to control movement of the servo spool. A compensator piston is mounted for limiting sliding movement within the compensator piston cylinder relative to the open end thereof. The compensator piston is constructed with an outer end engaged with the swashplate, and with an inner end spaced from the servo spool by a compensator piston chamber configured to be in fluid communication with a source of pressurized fluid. A spring is connected between the servo spool and the compensator piston, and is configured to provide a spring force in response to the coil force applied to the servo spool to control movement thereof. Upon application of the coil force to move the servo spool, the pressurized fluid delivered to the compensator piston chamber moves the compensator piston to provide the spring force which is exerted against the servo spool, and to force the swashplate towards the maximum stroke position. The control arrangement defines a feedback system configured to maintain a balancing relationship between the servo spool and the spring to enable infinite control of the swashplate position.

The present disclosure additionally relates to an axial piston pump which includes a housing having an outer wall defining an interior with an end wall at one end of the housing, and a cover plate assembly at an opposite end of the housing. A drive shaft extends through the end wall of the housing and is rotatably mounted in the housing on a longitudinal drive shaft axially passing through the housing. A rotor is attached to the drive shaft for rotation therewith. A plurality of axially disposed cylinders is formed in the rotor and provided with axially reciprocable pistons disposed in the cylinders. A swashplate surrounds the drive shaft and is mounted in the housing for movement on a tilt axis extending transverse to the drive shaft axis between a no-stroke position in which a reaction surface of the swashplate engaged by the pistons lies perpendicular to the drive shaft axis, and a maximum stroke position in which the reaction surface of the swashplate is angularly disposed relative to the drive shaft axis.

A control arrangement for controlling the movement of the swashplate on the tilt axis includes a volume control piston assembly having a first inlet port supplied with a source of pressurized fluid and configured to bias the swashplate to the no-stroke position, and a compensator piston assembly having a second inlet port supplied with the source of pressurized fluid and configured to bias the swashplate to the maximum stroke position. The volume control piston assembly and at least a portion of the compensator piston assembly is mounted in the housing and engaged with the outer portions of the swashplate. The compensator piston assembly includes a compensator piston cylinder provided with the second inlet port and a tank port in communication with a tank, the compensator piston cylinder having a closed end and an open end. A servo spool is mounted for limited sliding movement within the compensator piston cylinder and is configured with a main portion to provide fluid communication with the second inlet port and the tank port. A solenoid coil is disposed in the closed end of the compensator piston cylinder in surrounding relationship with an end portion of the servo spool, and is configured to be connected to a source of electrical power to provide a coil force to control movement of the servo spool. A compensator piston is mounted for limited sliding movement within the compensator piston cylinder relative to the open end thereof, and is constructed with an outer end engaged with the swashplate, and an inner end spaced from the main portion of the servo spool by a compensator piston chamber configured to be in fluid communication with a fluid passageway in the main portion of the servo spool, the second inlet port and the tank port of the compensator piston cylinder. A spring is connected between the servo spool and the compensator piston, the spring being configured to provide a spring force in response to the coil force applied to the servo spool to control movement thereof.

Upon application of the coil force to move the servo spool, pressurized fluid is delivered to the compensator piston chamber and moves the compensator piston to provide the spring force which is exerted against the servo spool, and to force the swashplate towards the maximum stroke position until the spring force equals the coil force at which point the swashplate is returned towards the no-stroke position. The control arrangement defines a feedback system configured to maintain a balancing relationship between the servo spool and the spring to enable infinite control of the swashplate position.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
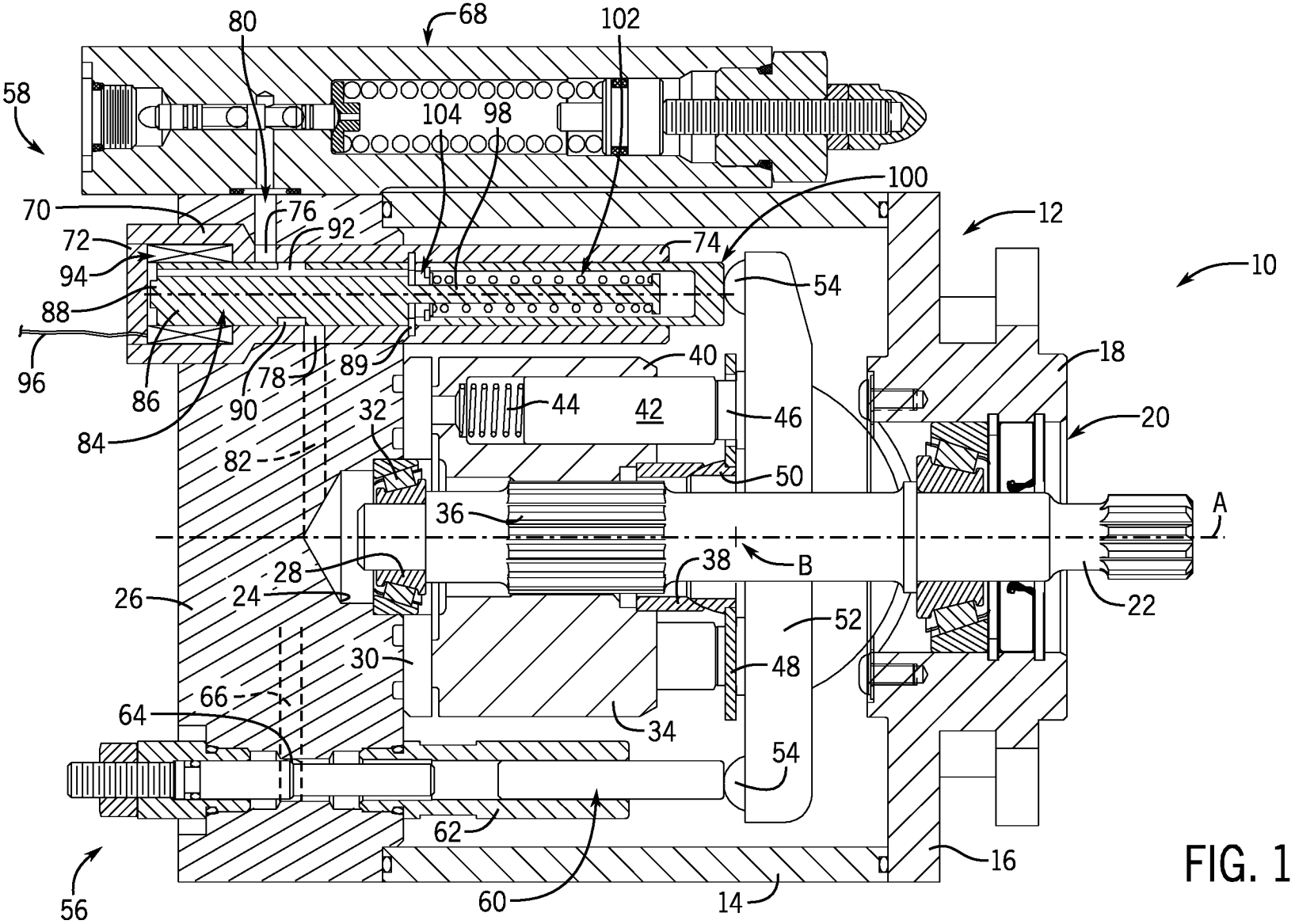
FIG. 1 is a vertical sectional view of an axial piston pump illustrating one embodiment of a swashplate control arrangement of the present disclosure at a no flow or no-stroke swash position.

Referring now to the drawings, there shown is an axial piston pump 10 including a housing 12 having an outer wall 14 and an integral end wall 16. The end wall 16 has an axially disposed hub 18 which is bored to include a roller bearing assembly 20 to rotatably support one end of a drive shaft 22. The one end of the drive shaft 22 extends outside the housing 12 and the wall 16, and is typically provided with a pulley, coupling or direct drive for receiving a drive belt or drive shaft from a suitable source of motive power, such as an electric motor. The opposite end of the drive shaft 22 is rotatably supported in a counterbore 24 of a port end cover 26 attached to the housing 12. The opposite end of the drive shaft also passes through a bore 28 of a valve plate 30 joined to the port end cover 26 in defining a cover plate assembly. A suitable bearing 32 is disposed between the walls of the counterbore 24 and the bore 28, and the opposite end of the drive shaft 22. The drive shaft 22 is rotatable about a longitudinal drive shaft axis A passing through the housing 12.

A rotor group or assembly including a generally cylindrical rotor 34 is mounted for rotation on the drive shaft 22 by a splined connection 36. The rotor 34 has a rear end which is designed to be rotatably engaged against the valve plate 30, and a front end which is constructed to receive a spherical load transfer ring 38 connected for rotation with the drive shaft 22 by the splined connection 36. The rotor 34 includes a plurality of circumferentially spaced axially extending cylinders 40 surrounding and parallel to the drive shaft 22. An axially reciprocable piston 42 and piston spring 44 is disposed in each cylinder 40. As is well known, each cylinder 40 is in communication with a source of hydraulic fluid for enabling reciprocal sliding movement of each piston 42 therein. The outer ends of the pistons 42 are provided with heads 46, each of which pass through an opening formed in a holddown plate 48 surrounding drive shaft 22 and having an inner portion 50 engageable with the spherical ring 38. In addition, each head 46 engages a smooth reaction surface on a rear face of a swashplate assembly having a swashplate 52. As is well known, the swashplate 52 is mounted for tilting movement about a center rotation B within the housing 12, about trunnion blocks that are fixed to the housing 12. Outer portions of the swashplate 52 are provided with semi spherical balls 54 for engaging an exposed end of a compensator piston and a volume control piston to be further described hereafter.

In accordance with the present disclosure, a swashplate control arrangement is provided for controlling a position of the swashplate 52 mounted for tilting movement between a no-stroke or no flow position and a maximum stroke or full flow position.

The swashplate control arrangement is comprised of a volume control piston assembly 56 mounted on one side of the housing 12, and a compensator piston assembly 58 mounted on an opposite side of the housing 12.

The volume control piston assembly 56 includes a volume control piston 60 which is slidably mounted for reciprocal movements in a volume control cylinder 62. The volume control piston assembly 56 has an inlet port 64 which is supplied by a source of pressurized hydraulic fluid through a line 66 in communication with a pump. The volume control piston 60 is also known as an off stroking piston because of its tendency to bias the swashplate 52 towards a no stroke (no flow or neutral) position.

The compensator piston assembly 58 includes a pressure compensator 68 positioned outside the housing 12. The pressure compensator 68 is in fluid communication with a compensator piston cylinder 70 mounted inside the housing 12 and having a closed end 72, an open end 74, an inlet port 76 and a tank port 78. The inlet port 76 is connected via a line 80 to a source of pressurized hydraulic fluid in the pressure compensator 68. The tank port 78 is connected via a drain line 82 to a tank or reservoir.

A servo (solenoid) spool 84 is mounted for limited sliding movement (i.e. with a short stroke) within an enlarged end of the compensator piston cylinder 70. The servo spool 84 has a main portion 86 with an outer end 88 which, in the no-stroke position (FIGS. 1 and 5), is spaced a small distance (0.010-0.030 inches) from the closed end of the compensator piston cylinder 70. An inner end 89 of the main portion 86, in the no-stroke position, is engaged against stop structure 87 (FIG. 2) projecting radially inwardly from the compensator piston cylinder 70. The main portion 86 of the servo spool 84 has a notch 90 which, in the no-stroke position, permits communication with the tank port 78, and an opening 92 which, in the no-stroke position, is out of fluid communication with the inlet port 76 leading to the source of pressurized hydraulic fluid in line 80. A solenoid coil 94 is disposed within the closed end 72 of the compensator piston cylinder 70 in surrounding relationship with an end of the main portion 86. The solenoid coil 94 is connected by a suitable wire 96 to a source of electrical power to provide a coil force to control movement of the servo spool 84.

The servo spool 84 also has a stem portion 98 which extends from the main portion 86 into an open interior of a compensator piston 100. A follow-up or servo spring 102 encircles the stem portion 98 inside the compensator piston 100. The servo spring 102 has one end which in engaged against a stop in the compensator piston 100, and an opposite end which is engaged against an enlarged end of the stem portion 98. The servo spring 102 is configured to provide a spring force in response to the coil force applied to the servo spool 84 to control movement thereof.

The compensator piston 100 is mounted for limited sliding movement within the compensator piston cylinder 70 relative to the open end 74 thereof. The compensator piston 100 has an outer end engaged with the swashplate 52, and an inner end spaced from the main portion 86 of the servo spool 84 by a compensator piston chamber 104 best seen in FIG. 2. The compensator piston chamber 104 is configured to be in fluid communication with a fluid passageway in the main portion 86 of the servo spool 84, the inlet port 76 and the tank port 78. The compensator piston 100 has a diameter A1 which is greater than a diameter A2 of the volume control piston 60.

Figure 5:
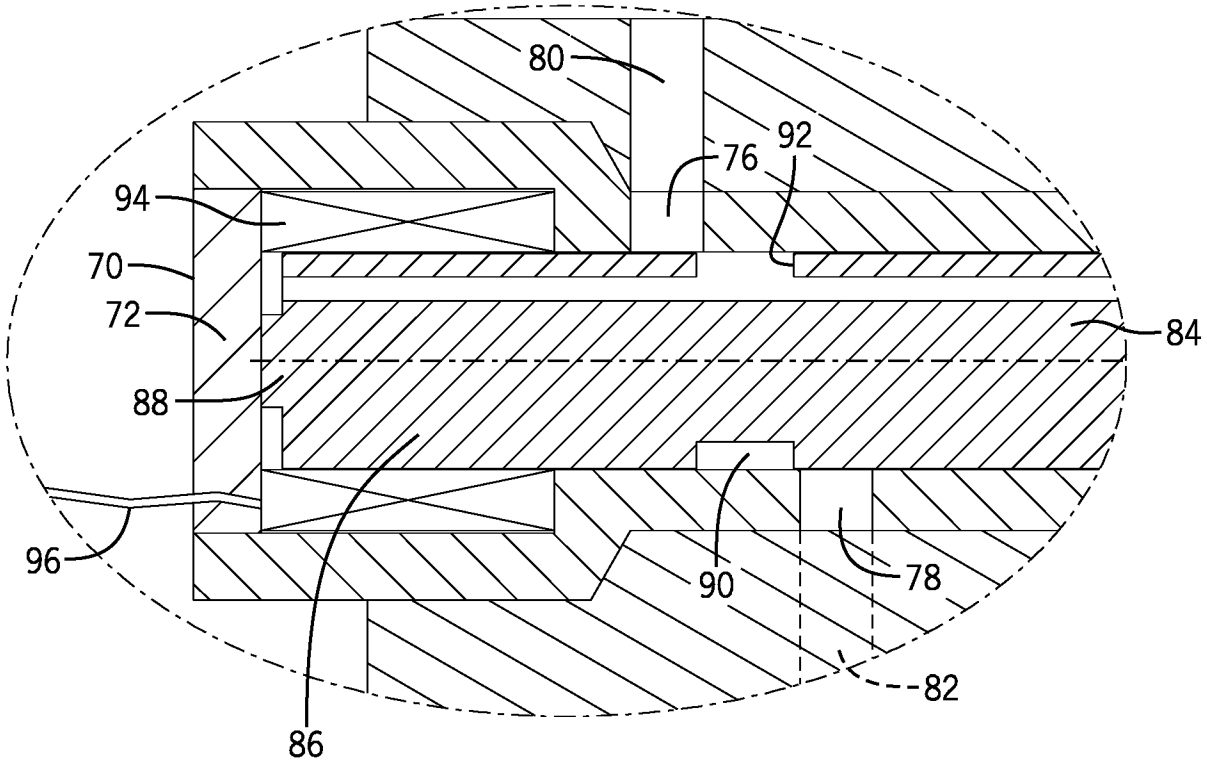
FIG. 5 is an enlarged detail view of a servo spool of the swashplate control arrangement in the no-stroke swash position.

In the no-stroke position of the swashplate 52 shown in FIGS. 1 and 5, the solenoid coil 94 is de-energized to maintain the position of the servo spool 84 such that no hydraulic fluid is delivered into the piston cylinder chamber 104 which is vented through a drain line 82, and the compensator piston 100 remains stationary. Fluid pressure is being delivered to the inlet port 64 of the volume control piston assembly 56 in order to continuously bias the volume control piston 60 against the swashplate 52 such that the reaction surface at the rear of the swashplate 52 is oriented generally perpendicular to the longitudinal axis A of the drive shaft 22.

Figure 2:
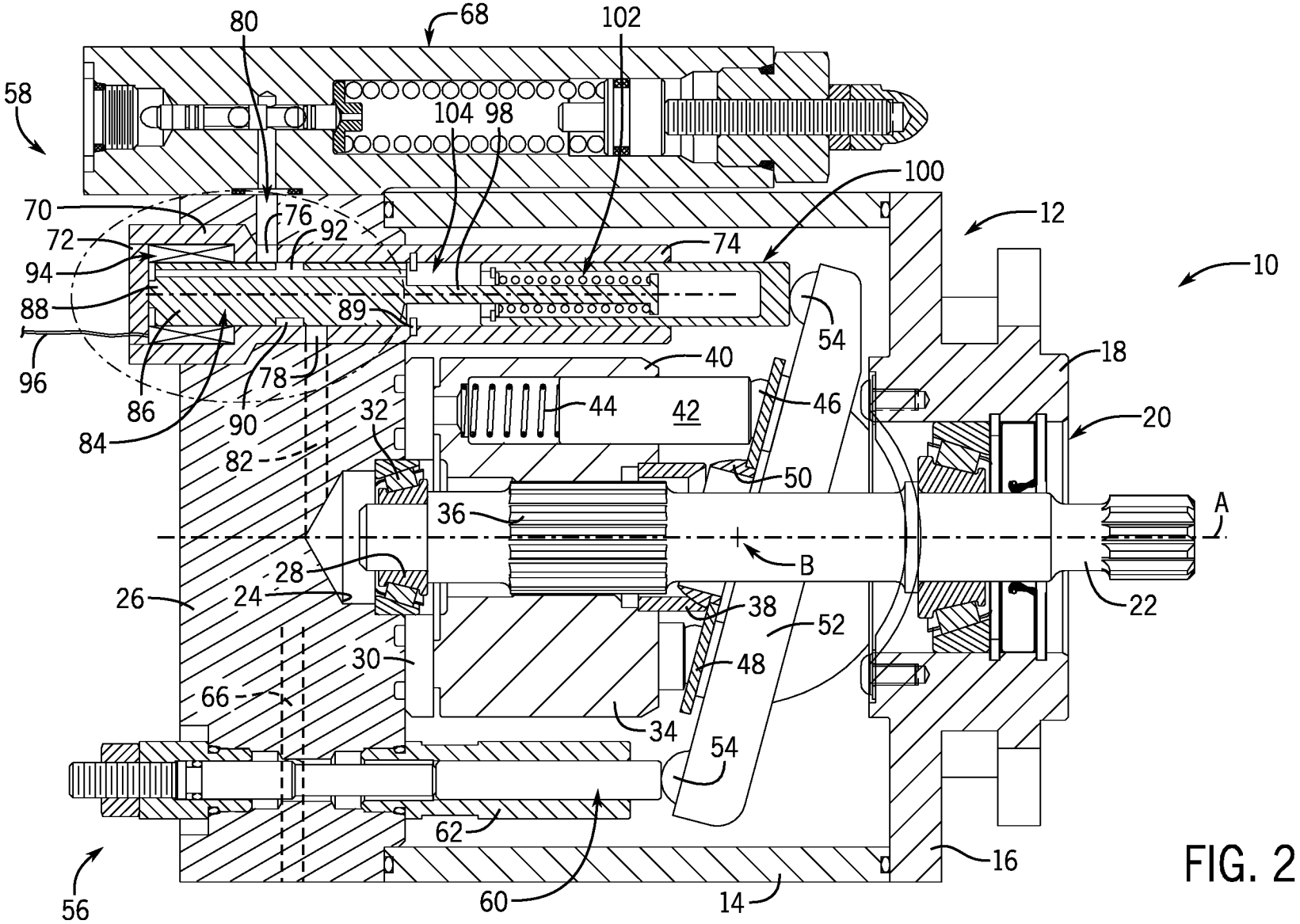
FIG. 2 is a view similar to FIG. 1, but showing the swashplate control arrangement at a full flow or maximum stroke swash position.
Figure 6:
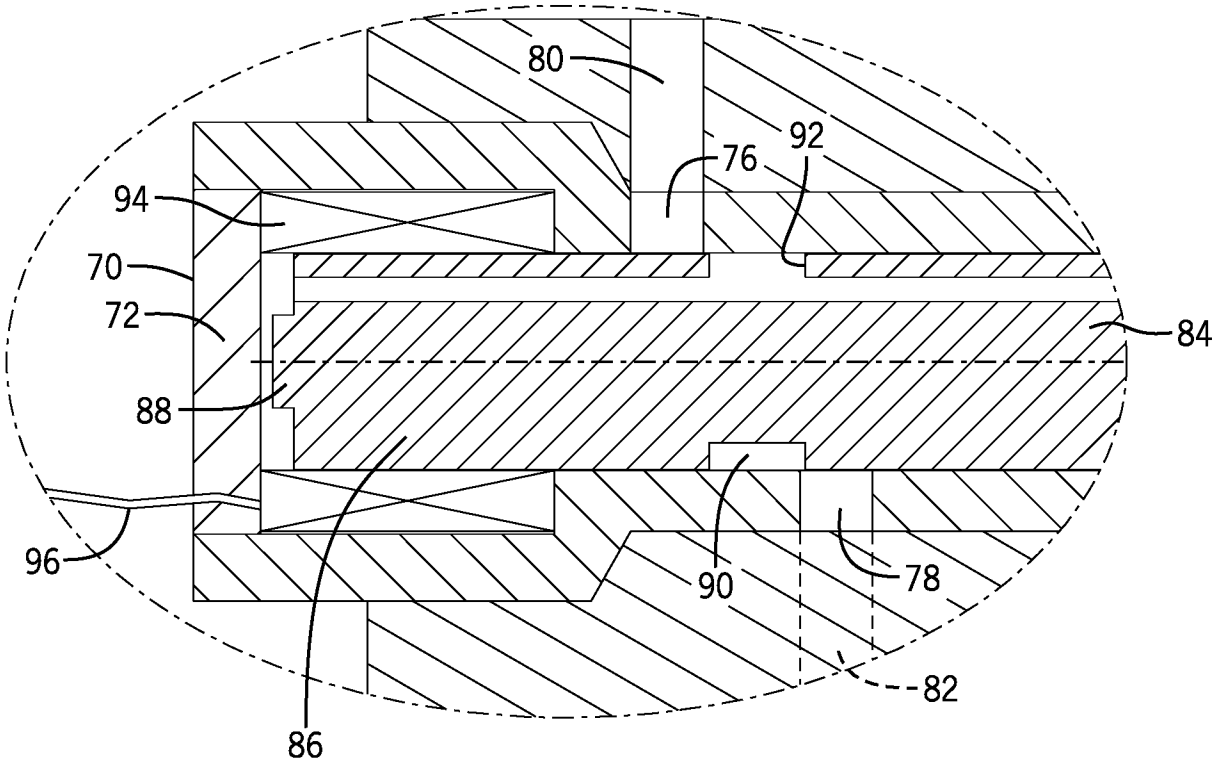
FIG. 6 is a view similar to FIG. 5 showing the servo spool in the maximum stroke position.

When it is desired to tilt the swashplate 52 from the no-stroke position of FIG. 1 towards the maximum stroke position of FIGS. 2 and 6, the solenoid coil 94 is first energized which causes the outer end 88 of the servo spool 84 to move to the left over the extremely short 0.010-0.030 inch travel towards the closed in 72 of the compensator piston cylinder 70. This slight movement or stroke of the servo spool 84 enables pressurized hydraulic fluid to flow from the pressure compensator 68 to the inlet port 76 into the opening 92 so that the hydraulic fluid is delivered via the fluid passageway in the servo spool 84 to the compensator piston chamber 104. As seen in FIG. 2, the hydraulic fluid acts to push the compensator piston 100 to the right and compress the servo spring 102. This results in creating a spring force which is exerted upon the servo spool 84, and in simultaneously forcing the swashplate 52 towards the maximum stroke position at which the reaction surface of the swashplate 52 is angularly oriented relative to the longitudinal axis A of the drive shaft 22. The compensator piston 100 will be fully extended in the swashplate 52 and will remain in the maximum stroke position as long as the coil force is greater than the spring force. However, at the point where the spring force equals the coil force, the swashplate 52 can be returned towards the no-stroke position of FIG. 1 (i.e. a swashplate position intermediate the position shown in FIGS. 1 and 2) by applying dither to the servo spool 84 so as to vary the amount of hydraulic fluid in the compensator piston chamber 104. That is, the servo spool 84 will dither (hover) about a position to maintain the position of the compensator piston 100 by using pump pressure to maintain the compensator piston position which occurs due to leakage past the compensator piston 100 to tank. When there is a loss of pressure behind the compensator piston 100, the servo spool force will move to maintain pressure and again the spring 102 matches the coil force. This all occurs in a matter of milliseconds so as to control swashplate position very precisely. At the same time, the swashplate 52 is urged back to the FIG. 1 position by volume control piston 60 which is continuously pressurized. The swashplate 52 can return to its no-stroke position by terminating current of the solenoid coil 94, or by using a hydromechanical control, such as the pressure compensator 68, to control pressure of the hydraulic fluid to the compensator piston cylinder 70. This could also be done using an electronic control and pressure transducer to maintain a position on the servo spool 84 by regulating the current to the solenoid coil 94. From the foregoing, it should be appreciated that the control arrangement defines a feedback system to maintain a balancing relationship between the servo spool 84 and the servo spring 104 to enable infinite control of the swashplate 52.

The unique feature of the present invention is that the servo spool 84 has a very short stroke (0.010-0.030 inches) and yet the compensator piston 100 can travel relatively longer distances depending on servo spring travel and force. The servo spring 102 and the servo spool 84 are configured to be hydraulically balanced with the only forces on the servo spool 84 being generated by the solenoid coil 94 and the servo spring 102.

Figure 3:
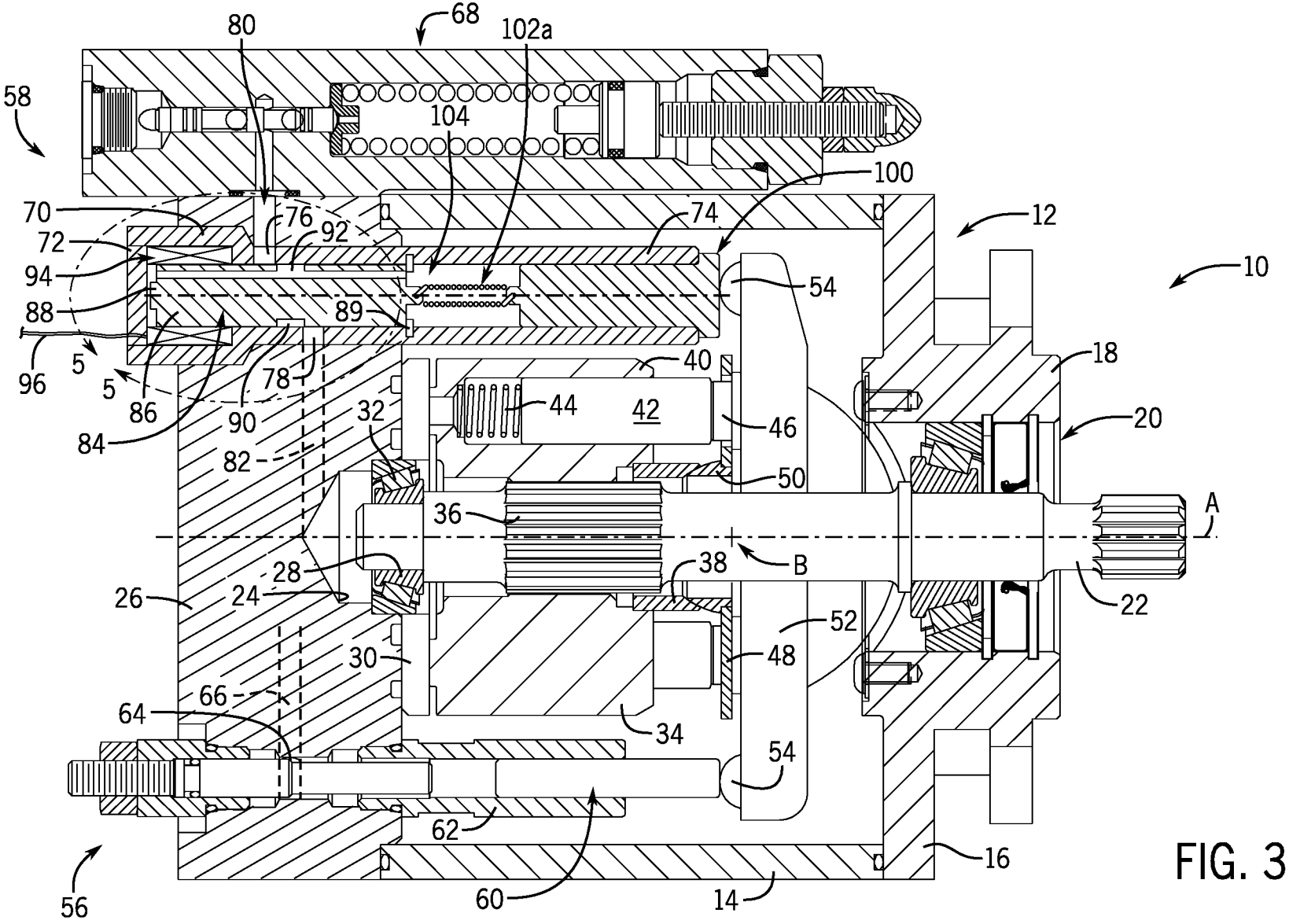
FIG. 3 is a vertical sectional view of illustrating another embodiment of a swashplate control arrangement at a no flow or no-stroke swash position.
Figure 4:
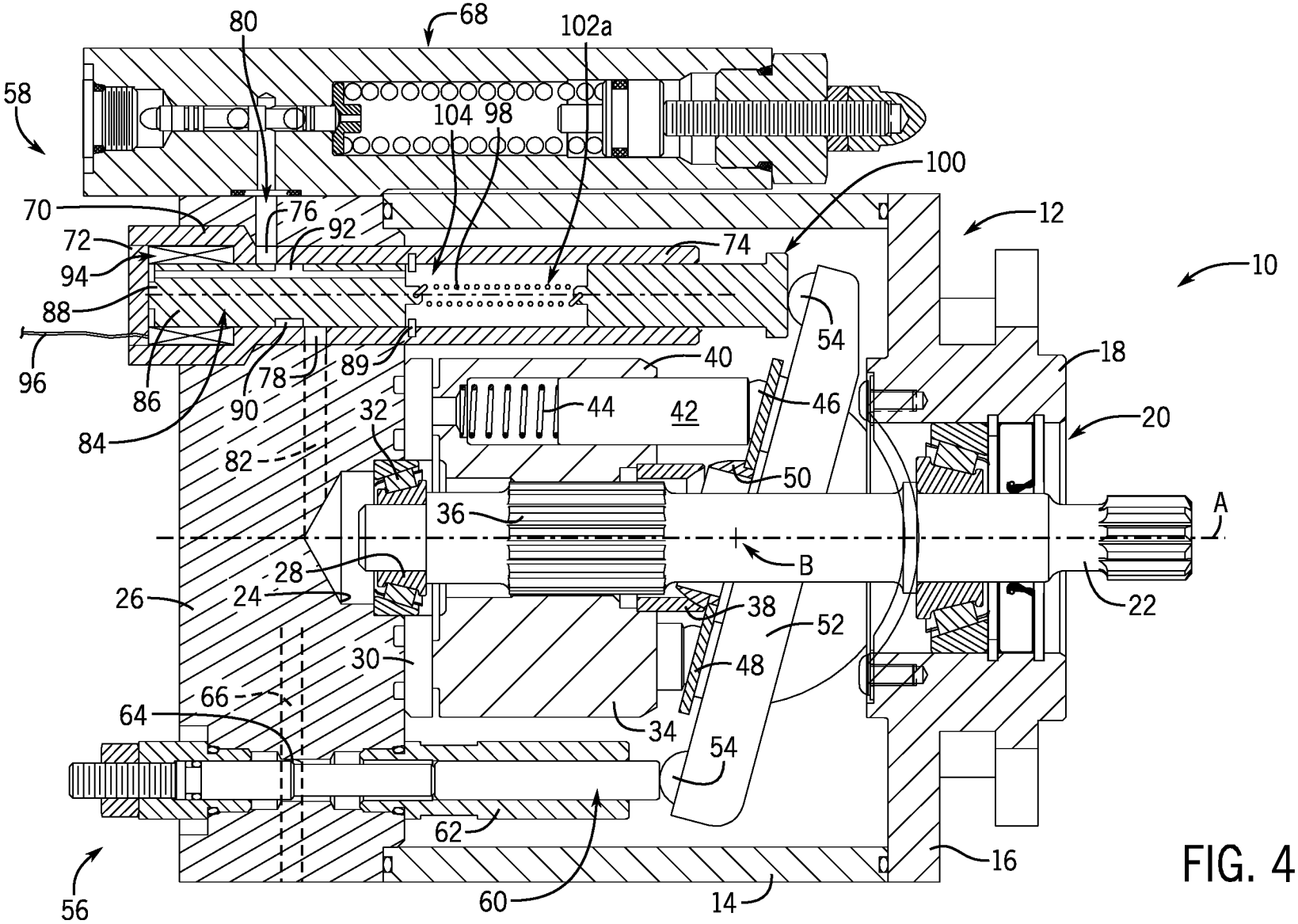
FIG. 4 is a view similar to FIG. 3, but showing the swashplate control arrangement at a full flow or maximum stroke swash position.

A further embodiment of the invention is shown in FIGS. 3 and 4, and is similar to the embodiment of FIGS. 1 and 2 except that the stem portion 98 of the servo spool 84 is eliminated and the follow-up spring 102 is replaced by an extension spring 102*a* which is connected between the servo spool 84 and the compensator piston 100, and is located in the compensator piston chamber 104.

The no-stroke position of FIG. 3 is similar to the no-stroke position of FIG. 1. When is desired to tilt the swashplate 52 towards the maximum stroke position of FIG. 4, the solenoid coil 94 is energized causing hydraulic fluid to flow to the compensator piston chamber 104. The fluid pressure in the chamber 104 forces the compensator piston 100 to move or extend to the right causing the extension spring 102*a* to extend and create a spring force. The control arrangement of FIGS. 3 and 4 operates in the same manner as FIGS. 1 and 2 to return the swashplate 52 towards the no-stroke position thereby providing the similar infinite control for the swashplate position.

The control arrangement can be programmed to perform load sensing, horse power limiting or any other type of output flow versus pressure action.

While the invention has been described with reference to a preferred embodiment, those skilled in the art will appreciate that certain substitutions, alterations and omissions may be made without departing from the sprit thereof. Accordingly, the foregoing description is meant to be exemplary only and should not be deemed limitative on the scope of the invention as set forth with the following claims.

What is claimed is:

1. A swashplate control arrangement for controlling a position of a swashplate mounted for tilting movement in an axial piston pump between a no-stroke position and a maximum stroke position, the swashplate control arrangement comprising:

a compensator piston assembly configured to bias the swashplate between the no-stroke position and the maximum stroke position, the compensator piston assembly including:

a compensator piston cylinder;

a servo spool mounted for sliding movement within the compensator piston cylinder, the servo spool including a main portion;

a solenoid coil disposed within the compensator piston cylinder and in a surrounding relationship with an outer end of the main portion of the servo spool, and configured to provide a coil force to control movement of the servo spool;

a compensator piston spaced from the servo spool and mounted for sliding movement within the compensator piston cylinder in response to movement of the main portion of the servo spool; and a spring connected between the servo spool and the compensator piston and in contact with each, and configured to provide a spring force in response to the coil force applied to the servo spool to bias the compensator piston toward the outer end of the main portion of the servo spool, wherein the swashplate control arrangement defines a feedback system configured to maintain a balancing relationship between the spring force and the coil force to enable control of the swashplate position between the no-stroke position and the maximum stroke position.

2. The swashplate control arrangement of claim 1, wherein the servo spool has a stem portion extending from the main portion into the compensator piston, wherein the spring is connected to the stem portion of the servo spool and surrounds the stem portion of the servo spool, wherein the compensator piston is movable along the stem portion.

3. The swashplate control arrangement of claim 1, wherein a compensator piston chamber is located between the servo spool and the compensator piston, and is configured to be in fluid communication with a source of hydraulic fluid controllably supplied to and drained from the compensator piston cylinder via a fluid passageway formed in the servo spool.

4. The swashplate control arrangement of claim 1, including a pressure compensator which is in fluid communication with the compensator piston cylinder.

5. The swashplate control arrangement of claim 1, wherein the compensator piston cylinder is provided with an inlet port and a tank port.

6. The swashplate control arrangement of claim 5, wherein the servo spool is configured to provide fluid communication with the inlet port and the tank port.

7. The swashplate control arrangement of claim 6, wherein the servo spool is formed with an opening which is moveable into and out of communication with the inlet port.

8. The swashplate control arrangement of claim 7, wherein the servo spool is formed with a notch which is movable into and out of communication with the tank port.

9. In an axial piston pump having a rotor attached to a drive shaft rotatably positioned in a housing, and a swashplate surrounding the drive shaft and mounted for movement on a tilt axis between a no-stroke position and a maximum stroke position, a control arrangement for controlling the position of the swashplate on the tilt axis comprising:

a compensator piston assembly configured to bias the swashplate between the no-stroke position and the maximum stroke position;

wherein the compensator piston assembly includes:

a compensator piston cylinder having a closed end and an open end;

a servo spool mounted for limited sliding movement within the closed end of the compensator piston cylinder, the servo spool including a main portion;

a solenoid coil disposed within the closed end of the compensator piston cylinder in surrounding relationship with an outer end of the main portion of the servo spool, and configured to be connected to a source of electrical power to provide a coil force to control movement of the servo spool;

a compensator piston mounted for limited sliding movement within the compensator piston cylinder relative to the open end thereof, and constructed with an outer end engaged with the swashplate, and an inner end spaced from the servo spool by a compensator piston chamber configured to be in fluid communication with a source of pressurized fluid; and a spring connected between the servo spool and the compensator piston and in contact with each, and configured to provide a spring force in response to the coil force applied to the servo spool to bias the compensator piston toward the outer end of the main portion of the servo spool, wherein, upon application of the coil force to move the servo spool, the pressurized fluid delivered to the compensator piston chamber moves the compensator piston to provide the spring force which is exerted against the servo spool, and to force the swashplate towards the maximum stroke position, the control arrangement defining a feedback system configured to maintain a balancing relationship between the servo spool and the spring to enable control of the swashplate position between the no-stroke position and the maximum stroke position.

10. The control arrangement of claim 9, wherein the servo spool has a a stem portion extending from the main portion into the compensator piston, wherein the spring is connected to the stem portion and surrounds the stem portion of the servo spool, wherein the compensator piston is movable along the stem portion.

11. An axial piston pump comprising:

a housing having an outer wall defining an interior with an end wall at one end of the housing, and a cover plate assembly at an opposite end of the housing;

a drive shaft extending through the end wall of the housing and rotatably mounted in the housing on a longitudinal drive shaft axis passing through the housing;

a rotor attached to the drive shaft for rotation therewith;

a plurality of axially disposed cylinders formed in the rotor, and provided with axial reciprocable pistons disposed in the cylinders;

a swashplate surrounding the drive shaft and mounted in the housing for movement on a tilt axis extending transverse to the drive shaft axis between a no-stroke position and a maximum stroke position, wherein in the no-stroke position a reaction surface of the swashplate engaged by the pistons lies perpendicular to the drive shaft axis, and wherein in the maximum stroke position the reaction surface of the swashplate is angularly disposed relative to the drive shaft axis; and a control arrangement for controlling the movement of the swashplate on the tilt axis, the control arrangement including a volume control piston assembly having a first inlet port supplied with a source of pressurized fluid and configured to bias the swashplate to the no-stroke position, and a compensator piston assembly having a second inlet port supplied with the source of pressurized fluid and configured to bias the swashplate to the maximum stroke position, the volume control piston assembly and at least a portion of the compensator piston assembly being mounted in the housing and engaged with outer portions of the swashplate, wherein the compensator piston assembly includes:

a compensator piston cylinder provided with the second inlet port and a tank port in communication with a tank, the compensator piston cylinder having a closed end and an open end;

a servo spool mounted for limited sliding movement within the compensator piston cylinder and configured with a main portion to provide fluid communication with the second inlet port and the tank port and a stem portion extending from the main portion;

a solenoid coil disposed in the closed end of the compensator piston cylinder in surrounding relationship with an end portion of the servo spool, and configured to be connected to a source of electrical power to provide a coil force to control movement of the servo spool;

a compensator piston mounted for limited sliding movement along the stem portion of the servo spool within the compensator piston cylinder relative to the open end thereof, and constructed with an outer end engaged with the swashplate and an inner end spaced from the main portion of the servo spool by a compensator piston chamber configured to be in fluid communication with a fluid passageway in the main portion of the servo spool, the second inlet port and the tank port of the compensator piston cylinder; and a servo spring connected between the stem portion of the servo spool and the compensator piston and in contact with each, the spring being configured to provide a spring force in response to the coil force applied to the servo spool to bias the compensator piston toward the main portion of the servo spool, wherein, upon application of the coil force to move the servo spool, pressurized fluid is delivered into the compensator piston chamber and moves the compensator piston to provide the spring force which is exerted against the servo spool, and to force the swashplate towards the maximum stroke position until the spring force equals the coil force at which point the swashplate is returned towards the no-stroke position, the control arrangement defining a feedback system configured to maintain a balancing relationship between the servo spool and the spring to enable control of swashplate position between the no-stroke position and the maximum stroke position.

12. The axial piston pump of claim 11, wherein the volume control piston assembly includes a volume control piston mounted for sliding movement in a volume control cylinder.

13. The axial piston pump of claim 12, wherein a diameter of the compensator piston is greater than a diameter of the volume control piston.

14. The axial piston pump of claim 11, wherein the spring is positioned within the compensator piston chamber.

* * * * *